US011433523B2

(12) United States Patent
Li

(10) Patent No.: US 11,433,523 B2
(45) Date of Patent: Sep. 6, 2022

(54) MULTIFUNCTIONAL TOOL

(71) Applicant: Yangjiang City Xiangmao Trading Co., Ltd., Yangjiang (CN)

(72) Inventor: Guimin Li, Benxi (CN)

( * ) Notice: Subject to any disclaimer, the term of this patent is extended or adjusted under 35 U.S.C. 154(b) by 216 days.

(21) Appl. No.: 16/911,010

(22) Filed: Jun. 24, 2020

(65) Prior Publication Data

US 2021/0394350 A1 Dec. 23, 2021

(30) Foreign Application Priority Data

Jun. 17, 2020 (CN) ..... 202021115915.4

(51) Int. Cl.

| | |
|---|---|
| ***B25F 1/04*** | (2006.01) |
| ***B25G 3/38*** | (2006.01) |
| ***B25G 3/12*** | (2006.01) |
| ***B26B 5/00*** | (2006.01) |

(52) U.S. Cl.

CPC ..... *B25F 1/04* (2013.01); *B25G 3/12* (2013.01); *B25G 3/38* (2013.01); *B26B 5/00* (2013.01)

(58) Field of Classification Search

CPC .... B25F 1/04; B25G 3/12; B25G 3/38; B26B 5/00

USPC ..... 81/490, 491

See application file for complete search history.

(56) References Cited

U.S. PATENT DOCUMENTS

| | | | | |
|---|---|---|---|---|
| 7,181,849 | B2 * | 2/2007 | Menter | B25G 1/08 30/155 |
| 8,182,166 | B2 * | 5/2012 | Colman | B43K 23/00 401/6 |
| 8,549,687 | B1 * | 10/2013 | Alexander | B25B 23/0007 7/128 |

* cited by examiner

*Primary Examiner* — Hadi Shakeri
(74) *Attorney, Agent, or Firm* — Rumit Ranjit Kanakia

(57) ABSTRACT

The present disclosure provides a multifunctional tool kit. The multifunctional tool kit knit includes a connecting piece, a cover, a tool, a first shank, and a second shank. The cover is connected to an upper end of the connecting piece. The first shank and the second shank are connected to a lower end of the connecting piece. The tool is inserted into a second hole to reach the bottom of a pin hole. By rotating the cover, the tool is locked on the connecting piece. The first shank and the second shank are movably connected to the connecting piece, and are reversely rotatable by 180 degrees to engage with each other define a handle. The present disclosure achieves effects of saving space and resources, and implementing multiple integrated functions with one tool.

3 Claims, 24 Drawing Sheets

MULTIFUNCTIONAL TOOL

TECHNICAL FIELD

The present disclosure relates to the technical field of home tool manufacturing, and in particular, relates to a multifunctional tool kit.

BACKGROUND

At present, people may use a variety of tools both at home or outdoors. For example, small knives, screwdrivers, saw blades, files, cross screwdrivers, tooth knives, and the like are commonly used tools outdoors. Since these tools are generally separate ones, and it is not convenient to carry such tools together outdoors. Therefore, the present disclosure is intended to provide a multifunctional took kit which has a plurality of tool heads and is capable of implementing integrated functions of these tools.

SUMMARY

To overcome the defects in the related art, the present disclosure provides a novel multifunctional tool kit integrated with a plurality of tools which features simple structure, compactness, and convenience and practicability.

The present disclosure is practiced by the following technical solutions:

According to a technical solution, the present disclosure provides a multifunctional tool kit. The multifunctional tool kit includes a connecting piece, a cover, a tool, a first shank, and a second shank; wherein the connecting piece is provided with a first left groove, a first right groove, a pin hole, a rivet hole, and two ribs, the two ribs being respectively arranged on a front side surface and a rear side surface of the connecting piece, the first left groove being disposed a left side surface of the connecting piece and connected to an upper end of the first shank, the first right groove being disposed on a right side surface of the connecting piece and connected to an upper end of the second shank, the pin hole being disposed in a middle of the connecting piece and interconnected to a root portion of the tool, and the rivet hole being disposed on left and right sides of the connecting piece and allowing a rivet to pass through such that the first shank and the second shank are connected to the connecting piece and the first shank and the second shank is reversely swingable by 180 degrees;

the cover is movably connected to the connecting piece, the cover is provided with two strip-shaped recesses, a second hole, a second left groove, and a second right groove, the two strip-shaped recesses being oppositely arranged on an inner wall of the cover and engaged with the two ribs arranged on the front side surface and the rear side surface of the connecting piece, the second hole being aligned with the pin hole arranged on the connecting piece to allow the root portion of the tool to be inserted, and the second left groove and the second right groove being aligned with the first left groove and the first right groove arranged on the connecting piece to allow the first shank and the second shank to be folded and fastened; and the tools includes a knife, a table knife, a fork, a spoon, a pet comb, scissors, a box dismantling knife, a saw blade, a cross screwdriver, a hexagonal screw remover, a file, a micro flashlight, a red wind corkscrew, a peeling blade, a beer cap opener, a rope cutter, an electronic flame-off torch, a hexagonal spoon, and a slotted screwdriver, and the root portion of the tool is provided with a locking recess, and a cam pin, the cam pin passing through the second hole to be inserted into the pin hole, such that the strip-shaped recesses are engaged with the ribs by rotating the cover and the locking recess is staggeredly engaged with the second hole to fix the tool to the connecting piece.

The first shank and the second shank are both provided with a slot configured to accommodate the tool, the first shank and the second shank are reversely rotatable by 180 degrees to define a chamber configured to accommodate the tool, and received on a receiving portion arranged on a tail end of the first shank by a swing locking piece arranged on a tail end of the second shank, such that the first shank and the second shank define a handle.

The swing locking piece is arranged on the tail end of the second shank and swingable by 180 degrees, and in case of opening for use or folding after use, the tool is locked by receiving the swing locking piece in a receiving portion.

As compared with the prior art, the present disclosure has the following advantages:

With the structure employed by the present disclosure, by rotating the cover, a plurality of tools may be fixed to the connecting piece and used as necessary by simple replacement of tool heads, such that integrated functions of these tools may be implemented by one tool kit. In addition, the first shank and the second shank is rotatable by 180 degrees. After use, the tools may be received in the slot, and thus the entire volume of the multifunctional tool kit is reduced. Therefore, the multifunctional tool kit saves space and resources, is conveniently used at home and easy to carry outdoors, and is convenient and practical. The multifunctional tool kit according to the present disclosure is simple in structure, smart in design, novel in style, and has a wide application range. The tool kit may be applicable to homes, restaurants, repairs, tours, outdoor activities, rescues, and the like, and has a powerful practicability.

In addition to the above described objects, features, and advantages, the present disclosure still has other objects, features, and advantages. The present disclosure is further described hereinafter with reference to the accompanying drawings.

BRIEF DESCRIPTION OF THE DRAWINGS

The accompanying drawings herein, which are incorporated herein and constitute a part of the specification, illustrate several exemplary embodiments of the present invention and together with the description, serve to illustrate the present disclosure, construing no limitation to the present disclosure. In the drawings.

DETAILED DESCRIPTION

Figure 1:
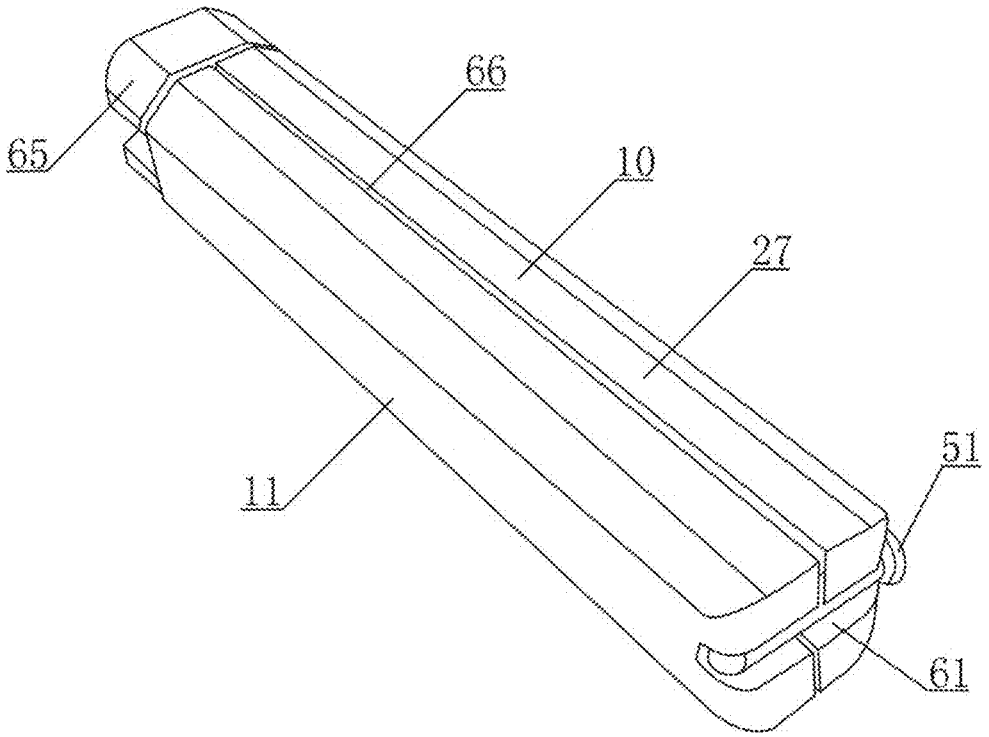
FIG. 1 is a schematic structural view of a multifunctional tool kit according to a preferred embodiment of the present disclosure.
Figure 2:
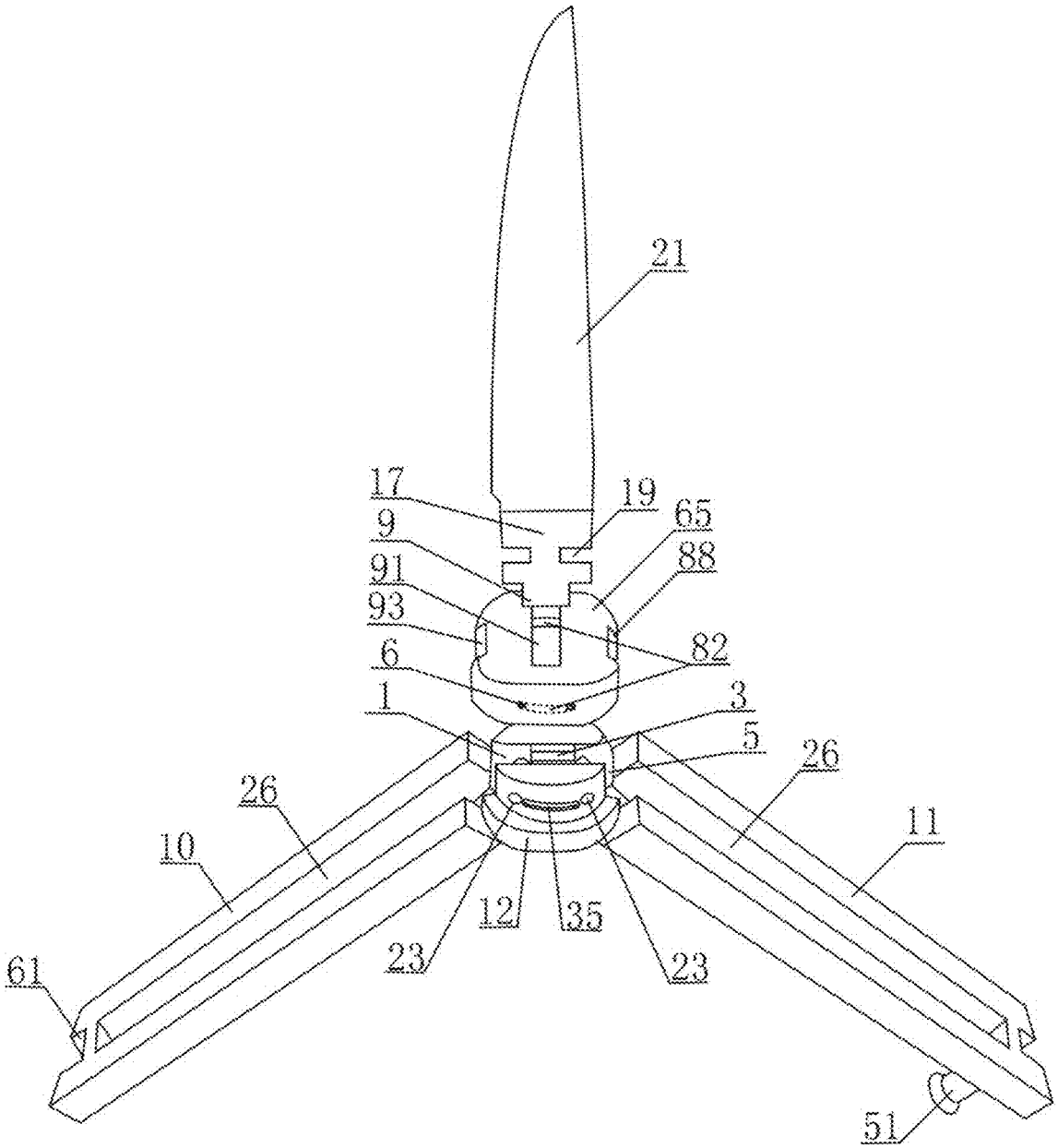
FIG. 2 is a schematic exploded structural view of the multifunctional tool kit according to a preferred embodiment of the present disclosure.
Figure 3:
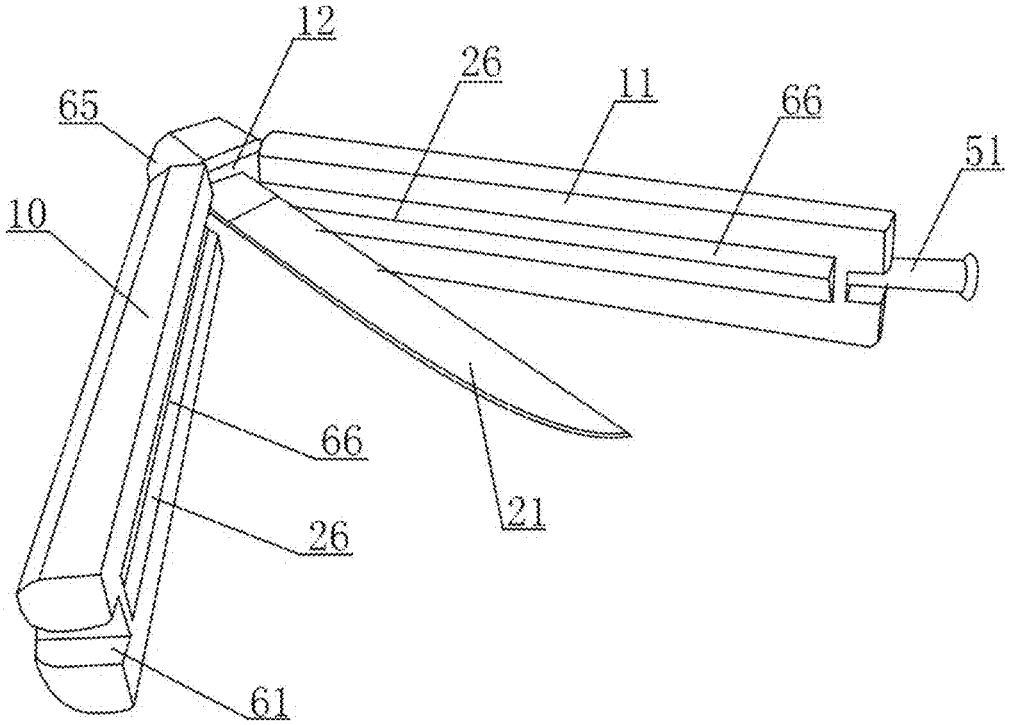
FIG. 3 is a schematic structural view of a folding process of the multifunctional tool kit according to a preferred embodiment of the present disclosure.

It needs to be noted that in case of no conflict, the embodiments and features in the embodiments of the present disclosure may be combined together. The present disclosure is described hereinafter in detail with reference to the accompanying drawings and specific embodiments.

As illustrated in FIG. 1, FIG. 2, FIG. 3, FIG. 4, FIG. 5, FIG. 6, FIG. 7, FIG. 8, FIG. 9, and FIG. 10, the present disclosure provides a multifunctional tool kit. The multifunctional tool kit includes a connecting piece 12, a cover 65, a tool 21, a first shank 10, and a second shank 11. The connecting piece is provided with a first left groove 1, a first right groove 5, a pin hole 3, a rivet hole 7, and two ribs 35 provided with protrusions 8. The two ribs are respectively arranged on a front side surface and a rear side surface of the connecting piece. The first left groove is disposed a left side surface of the connecting piece and connected to an upper end of the first shank. The first right groove is disposed on a right side surface of the connecting piece and connected to an upper end of the second shank. The pin hole is disposed in a middle of the connecting piece and interconnected to a root portion 17 of the tool. The rivet hole is disposed on left and right sides of the connecting piece and allows a rivet 23 to pass through such that the first shank and the second shank are connected to the connecting piece and the first shank and the second shank is reversely swingable by 180 degrees.

The cover is movably connected to the connecting piece, and the cover is provided with two strip-shaped recesses 82, a second hole 91, a second left groove 93, and a second right groove 88. The strip-shaped recesses 82 are provided with indents 6 engaged with the protrusions 8. The two strip-shaped recesses are oppositely arranged on an inner wall of the cover and engaged with the two ribs 35 arranged on the front side surface and the rear side surface of the connecting piece. The second hole 91 is aligned with the pin hole 3 arranged on the connecting piece to allow the root portion 17 of the tool to be inserted. The second left groove 93 and the second right groove 88 are aligned with the first left groove 1 and the first right groove 5 arranged on the connecting piece to allow the first shank and the second shank to be folded and fastened.

The tools 21 includes a knife, a table knife, a fork, a spoon, a pet comb, scissors, a box dismantling knife, a saw blade, a cross screwdriver, a hexagonal screw remover, a file, a micro flashlight, a red wind corkscrew, a peeling blade, a beer cap opener, a rope cutter, an electronic flame-off torch, a hexagonal spoon, and a slotted screwdriver. The root portion of the tool is provided with a locking recess 19, and a cam pin 9. The cam pin passes through the second hole to be inserted into the pin hole 3, such that the strip-shaped recesses 82 are engaged with the ribs 35 by rotating the cover 65. The protrusions 8 arranged on the ribs 35 are engaged with the indents 6 to fix the cover 65. When the cover is rotated, the second hole 91 is staggeredly engaged with the locking recess 19 to fix the tool, such that the tool 21 is fixed to the connecting piece 12.

Preferably, the first shank and the second shank are both provided with a slot 26 configured to accommodate the tool, the first shank and the second shank are reversely rotatable by 180 degrees to define a chamber 66 configured to accommodate the tool, and received on a receiving portion 61 arranged on a tail end of the first shank by a swing locking piece 51 arranged on a tail end of the second shank, such that the first shank and the second shank define a handle 27. The swing locking piece is arranged on the tail end of the second shank and is swingable by 180 degrees, and in case of opening for use or folding after use, the tool is locked by receiving the swing locking piece in a receiving portion 61.

Preferably, referring to FIG. 11, FIG. 12, FIG. 13, FIG. 14, FIG. 15, FIG. 16, FIG. 17; preferably, referring to FIG. 11, FIG. 12, FIG. 13, FIG. 14, FIG. 15, FIG. 16, FIG. 17, FIG. 18, FIG. 19, FIG. 20, FIG. 21, FIG. 22, FIG. 23, FIG. 24, FIG. 25, FIG. 26, FIG. 27, FIG. 28, and FIG. 29, the tools 21 include a knife 2, a table knife 4, a fork 13, a spoon 14, a pet comb 15, scissors 16, a box dismantling knife 20, a saw blade 22, a cross screwdriver 24, a hexagonal screw remover 25, a file 27, a micro flashlight 28, a red wind corkscrew 29, a peeling blade 30, a beer cap opener 31, a rope cutter 34, an electronic flame-off torch 36, a hexagonal spoon 37, and a slotted screwdriver 38. The scissors 16 are provided with an elastic sheet 18 configured to open the scissors and a locking pin 17 configured to lock the closing of the scissors. The beer cap opener 31 is provided with a plurality of opening wrenches 32 and a pull-type cap opener 33. The rope cutter 34 is provided with a clipper 36. This greatly creates convenience for users to use the multifunctional tool kit according to the present disclosure, such that the tool implements multiple functions, and effects of achieving integrated uses of the tool for the users. In addition, the functional tool greatly saves space and resources for the users. The above listed tools are only a portion of the tools. However, in practice, the tools may include any other suitable tool 21.

Figure 4:
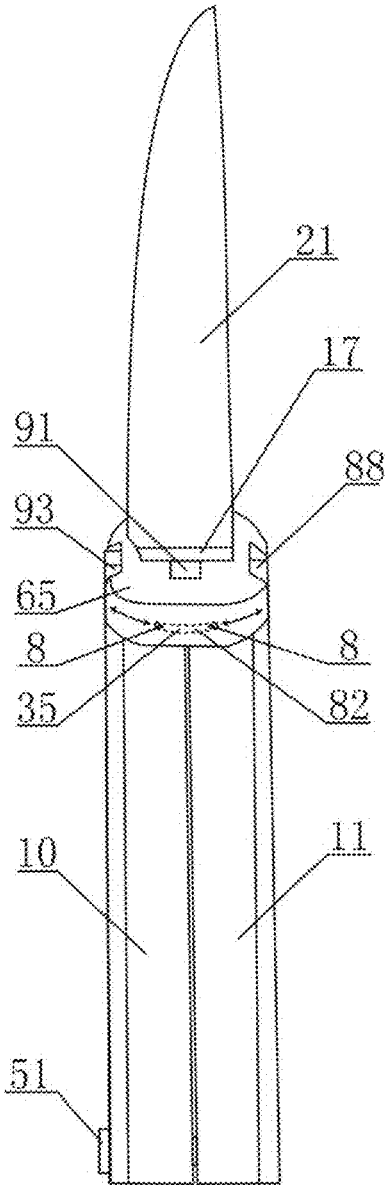
FIG. 4 is a schematic structural view of a scenario where a cover of the multifunctional tool kit is staggeredly engaged with a locking recess to fix the tool to the connecting piece according to a preferred embodiment of the present disclosure.
Figure 5:
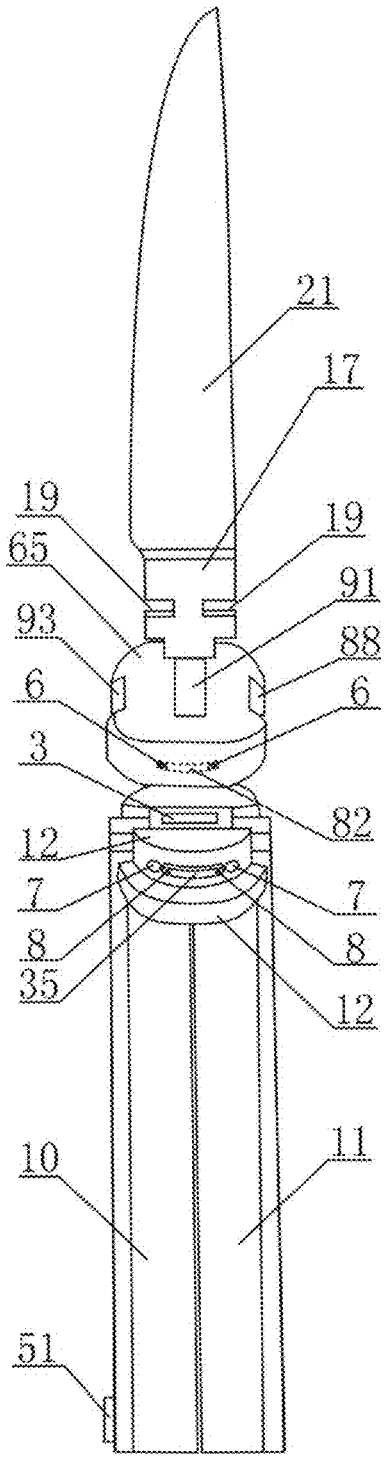
FIG. 5 is a schematic exploded structural view of the multifunctional tool kit as illustrated in FIG. 4 according to a preferred embodiment of the present disclosure.
Figure 6:
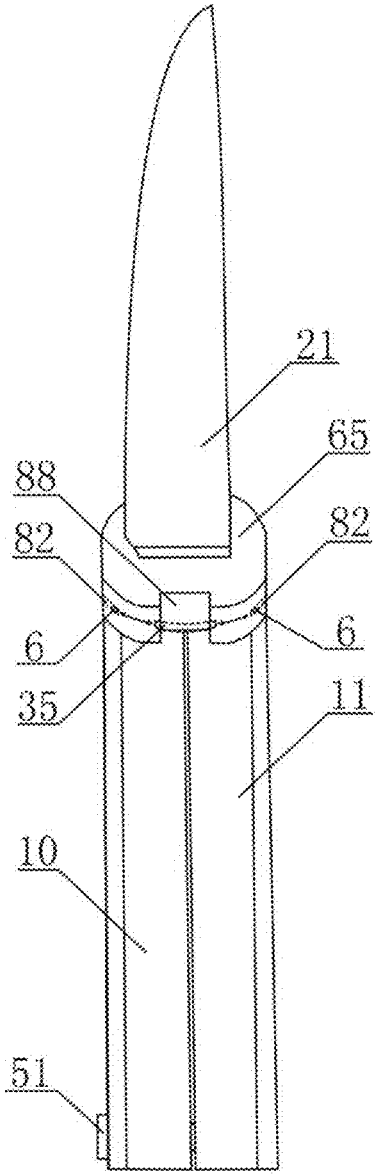
FIG. 6 is a schematic structural view of a scenario where the cover of the multifunctional tool kit is rotated to a replaceable tool according to a preferred embodiment of the present disclosure.
Figure 7:
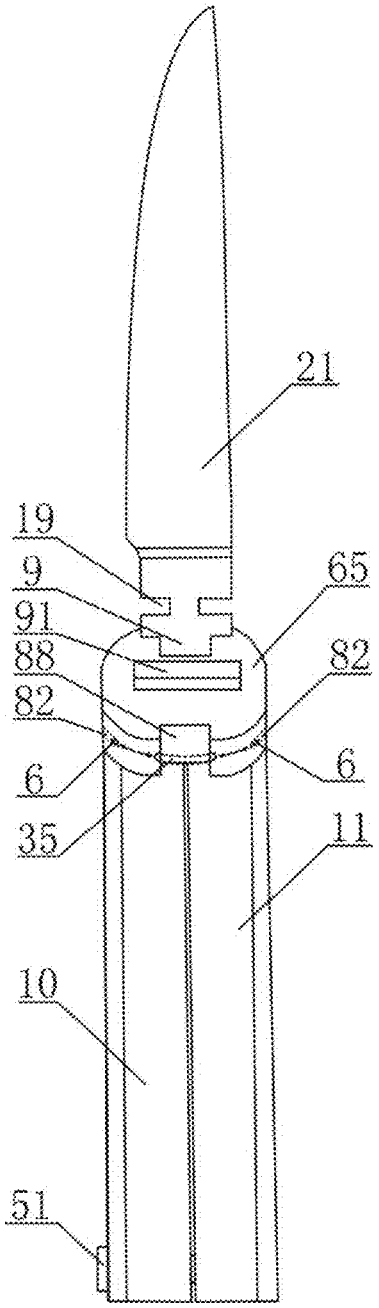
FIG. 7 is a schematic view of a state where the tool of the multifunctional tool kit is being replaced according to a preferred embodiment of the present disclosure.
Figure 8:
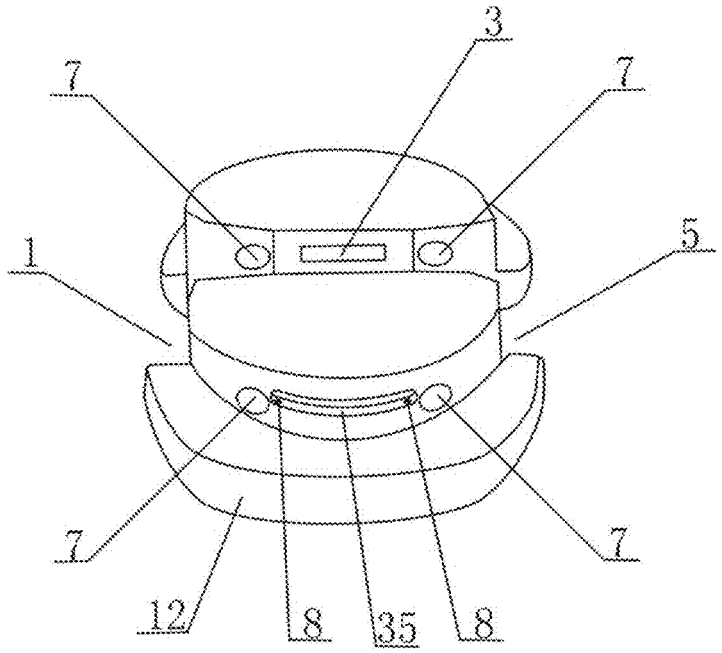
FIG. 8 is a schematic structural view of a connecting piece of the multifunctional tool kit according to a preferred embodiment of the present disclosure.
Figure 9:
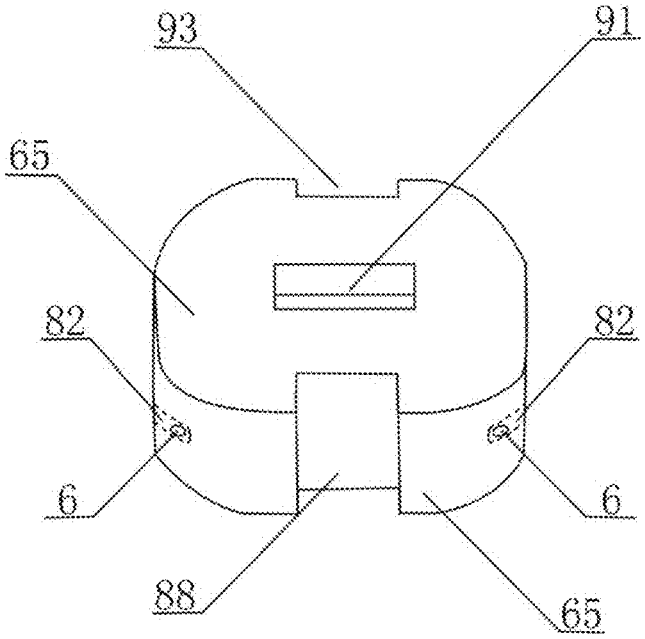
FIG. 9 is a schematic structural view of a cover of the multifunctional tool kit according to a preferred embodiment of the present disclosure.
Figure 10:
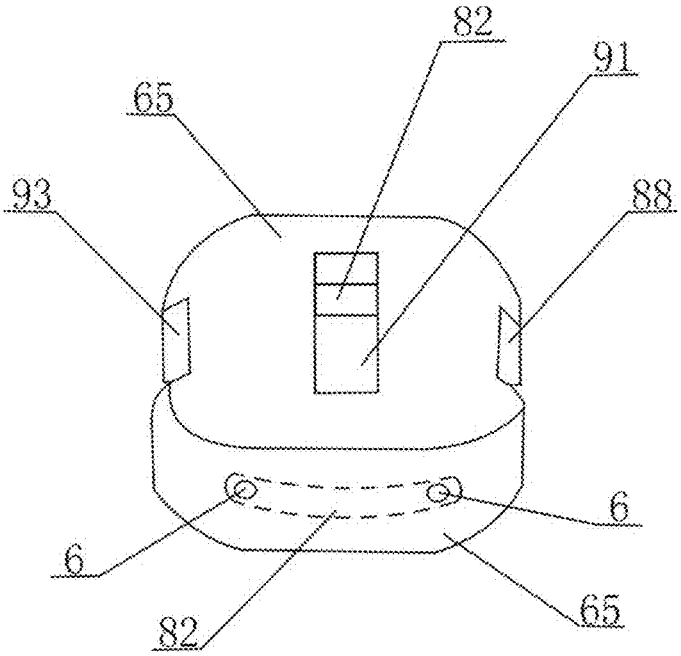
FIG. 10 is a schematic structural view taken from another surface of the cover of the multifunctional tool kit according to a preferred embodiment of the present disclosure.
Figure 11:
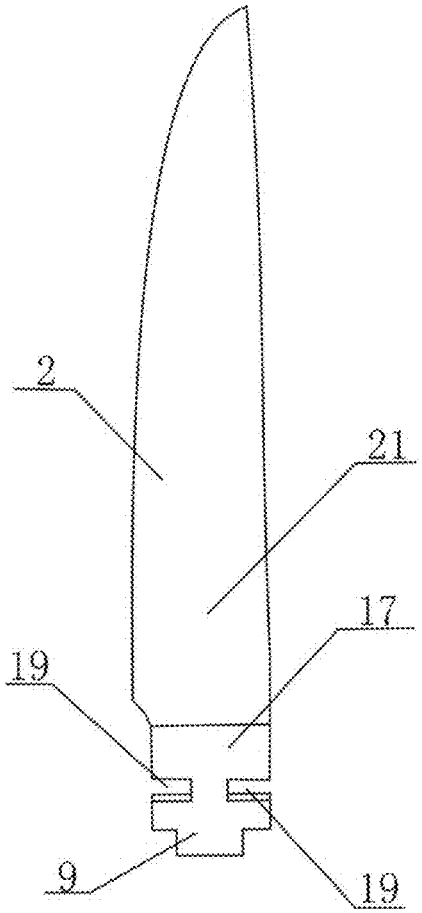
FIG. 11 is a schematic structural view of a tool, which is a knife, of the multifunctional tool kit according to a preferred embodiment of the present disclosure.
Figure 12:
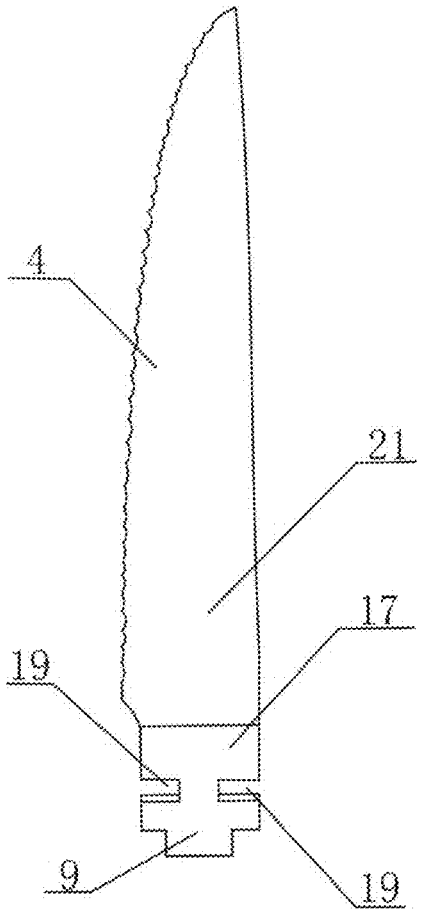
FIG. 12 is a schematic structural view of a tool, which is a table knife, of the multifunctional tool kit according to a preferred embodiment of the present disclosure.
Figure 13:
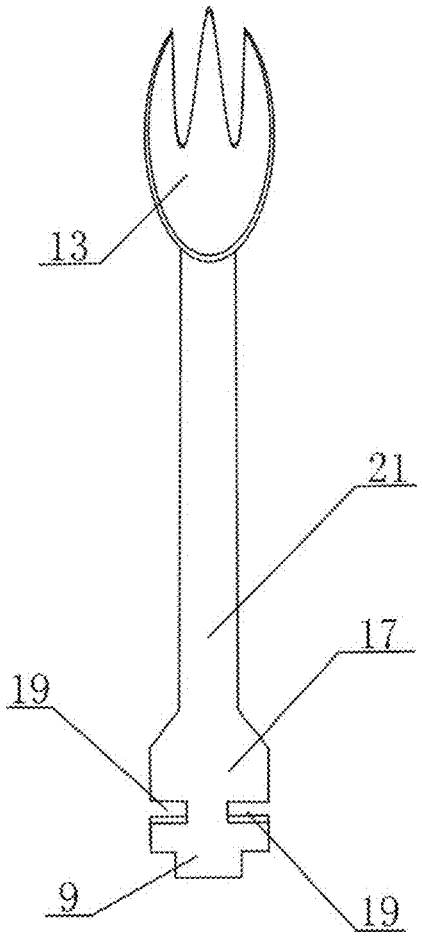
FIG. 13 is a schematic structural view of a tool, which is a fork, of the multifunctional tool kit according to a preferred embodiment of the present disclosure.
Figure 14:
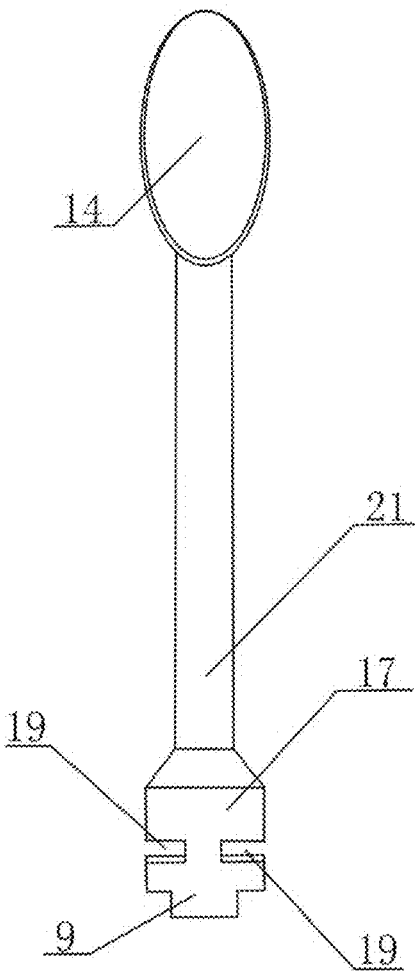
FIG. 14 is a schematic structural view of a tool, which is a spoon, of the multifunctional tool kit according to a preferred embodiment of the present disclosure.
Figure 15:
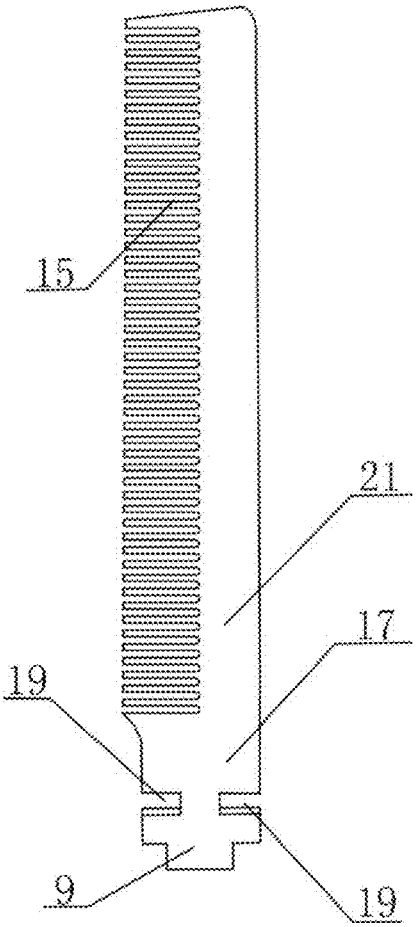
FIG. 15 is a schematic structural view of a tool, which is a pet comb, of the multifunctional tool kit according to a preferred embodiment of the present disclosure.
Figure 16:
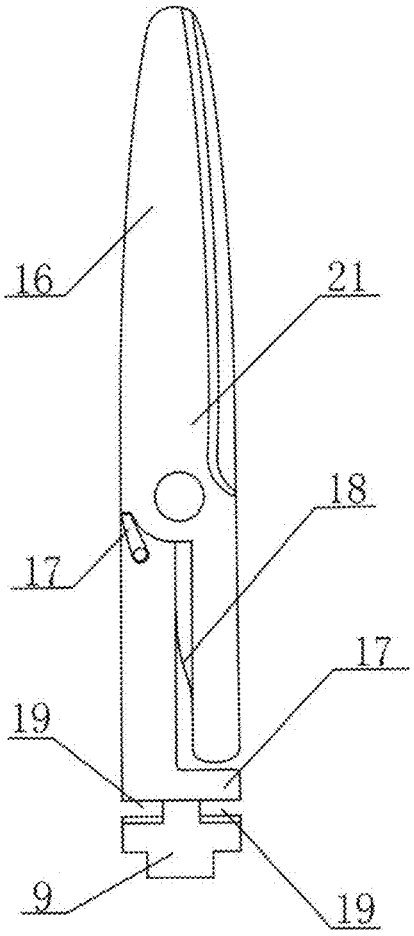
FIG. 16 is a schematic structural view of a tool, which is scissors, of the multifunctional tool kit according to a preferred embodiment of the present disclosure.
Figure 17:
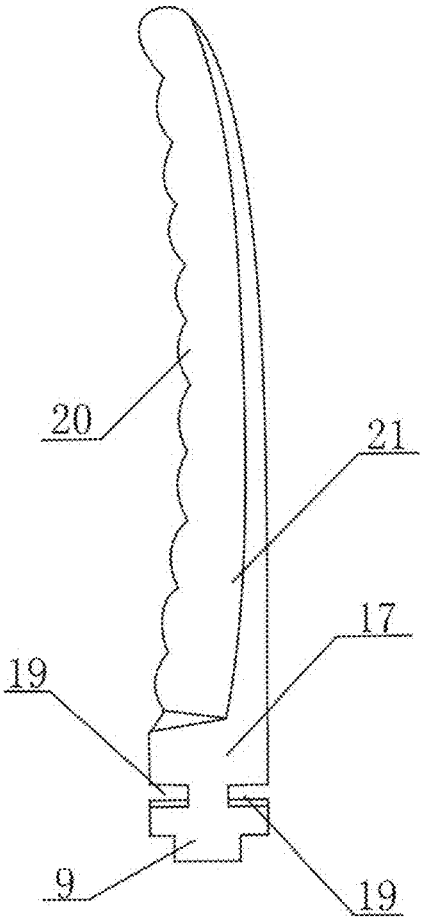
FIG. 17 is a schematic structural view of a tool, which is a box dismantling knife, of the multifunctional tool kit according to a preferred embodiment of the present disclosure.
Figure 18:
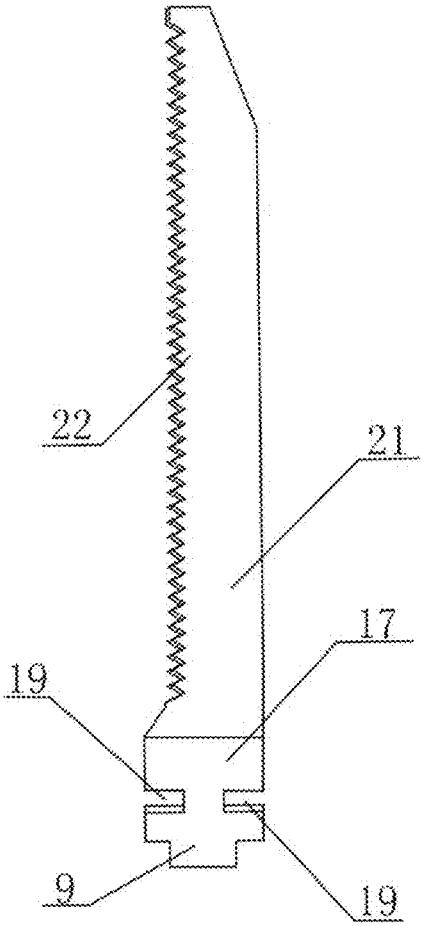
FIG. 18 is a schematic structural view of a tool, which is a saw blade, of the multifunctional tool kit according to a preferred embodiment of the present disclosure.
Figure 19:
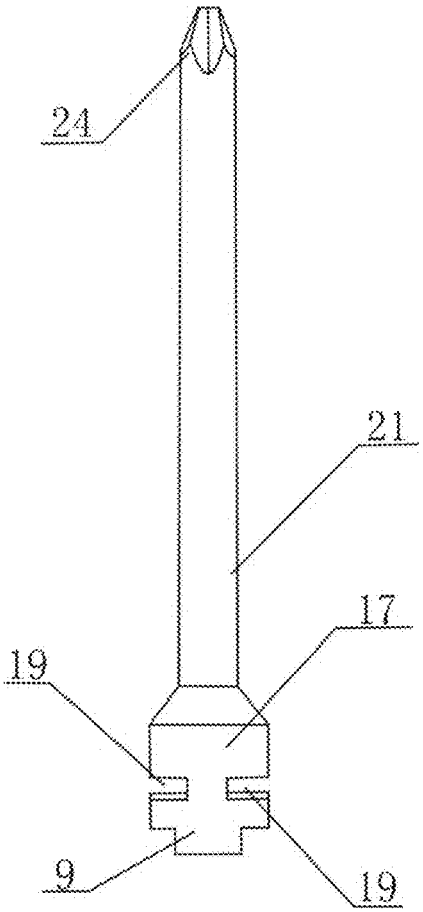
FIG. 19 is a schematic structural view of a tool, which is a cross screwdriver, of the multifunctional tool kit according to a preferred embodiment of the present disclosure.
Figure 20:
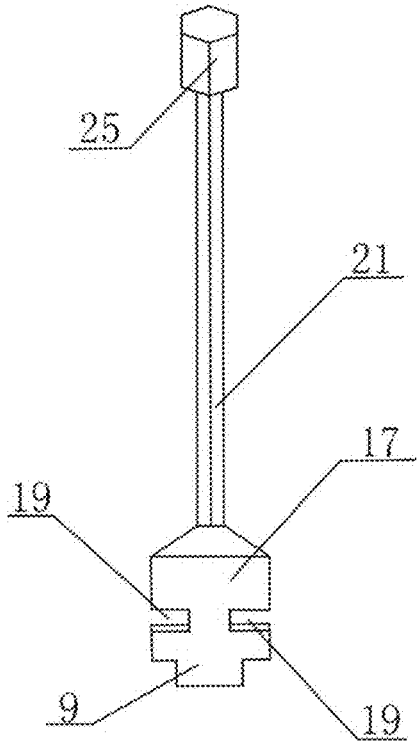
FIG. 20 is a schematic structural view of a tool, which is a hexagonal screw remover, of the multifunctional tool kit according to a preferred embodiment of the present disclosure.
Figure 21:
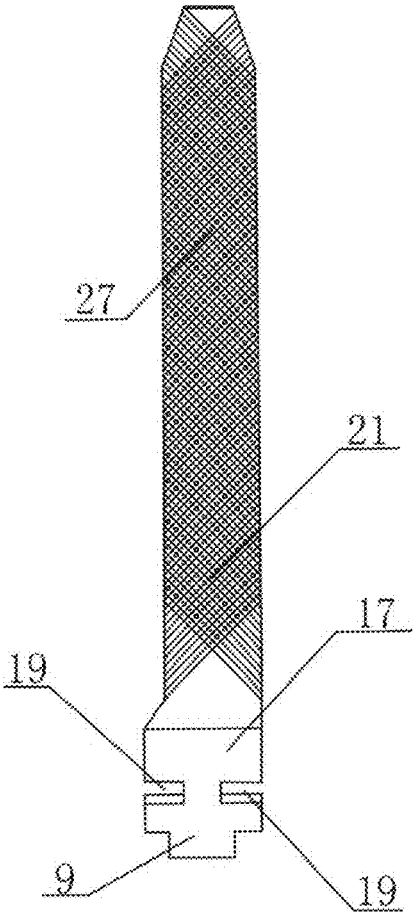
FIG. 21 is a schematic structural view of a tool, which is a file, of the multifunctional tool kit according to a preferred embodiment of the present disclosure.
Figure 22:
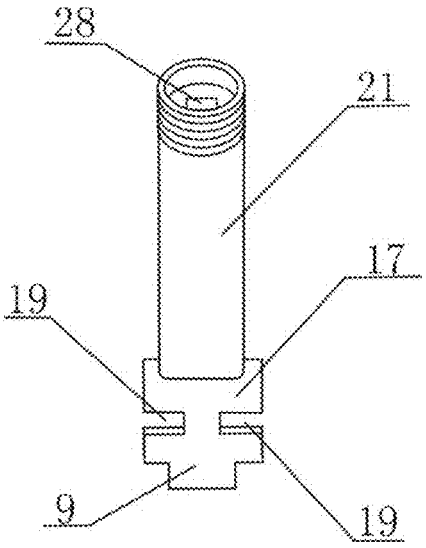
FIG. 22 is a schematic structural view of a tool, which is a micro flashlight, of the multifunctional tool kit according to a preferred embodiment of the present disclosure.
Figure 23:
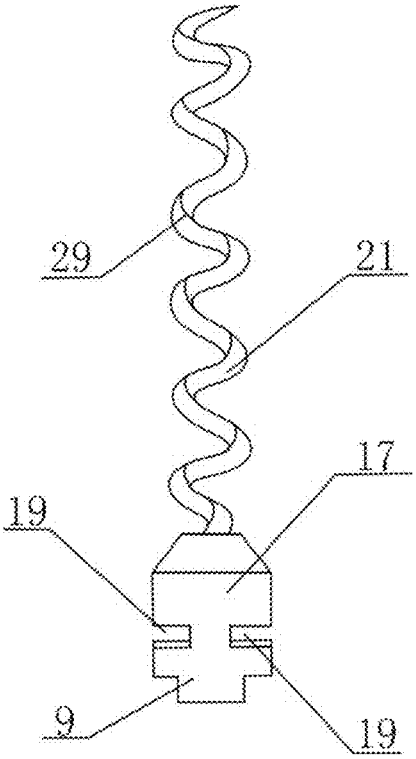
FIG. 23 is a schematic structural view of a tool, which is a red wine corkscrew, of the multifunctional tool kit according to a preferred embodiment of the present disclosure.
Figure 24:
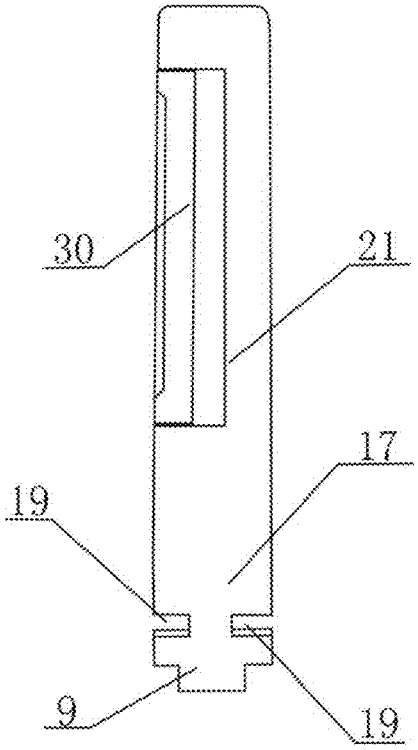
FIG. 24 is a schematic structural view of a tool, which is a peeling blade, of the multifunctional tool kit according to a preferred embodiment of the present disclosure.
Figure 25:
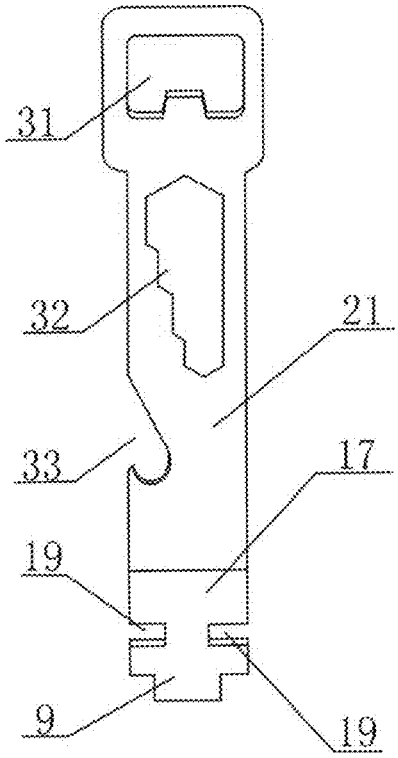
FIG. 25 is a schematic structural view of a tool, which is a beer cap opener, of the multifunctional tool kit according to a preferred embodiment of the present disclosure.
Figure 26:
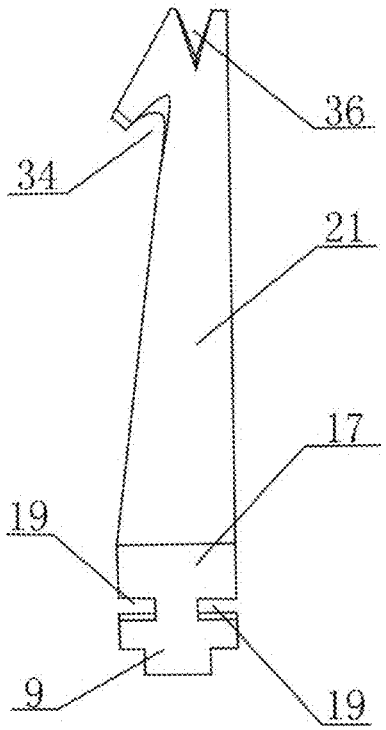
FIG. 26 is a schematic structural view of a tool, which is a rope cutter, of the multifunctional tool kit according to a preferred embodiment of the present disclosure.
Figure 27:
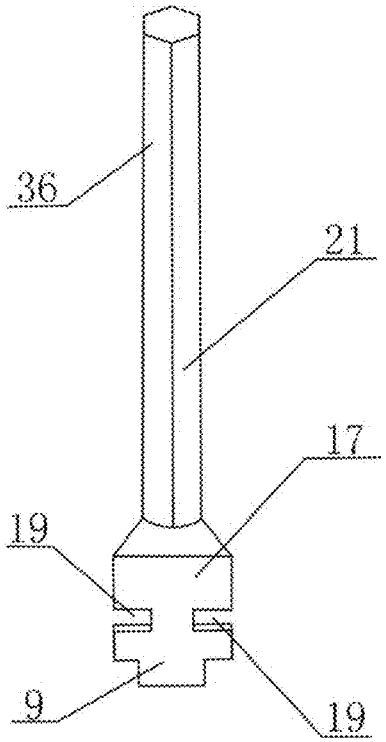
FIG. 27 is a schematic structural view of a tool, which is an electronic flame-off torch, of the multifunctional tool kit according to a preferred embodiment of the present disclosure.
Figure 28:
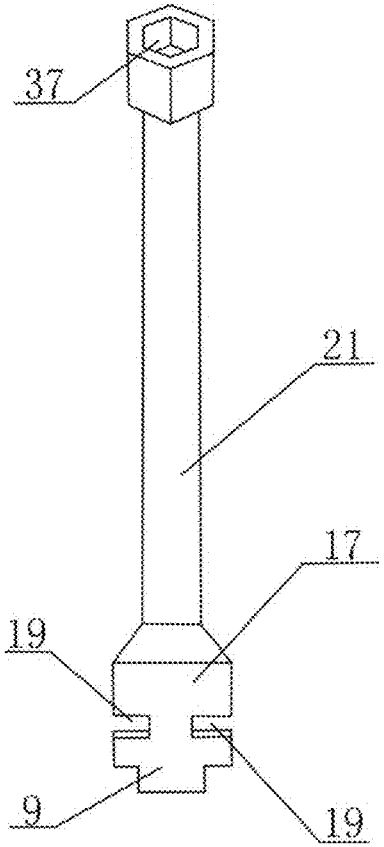
FIG. 28 is a schematic structural view of a tool, which is a hexagonal spoon, of the multifunctional tool kit according to a preferred embodiment of the present disclosure.
Figure 29:
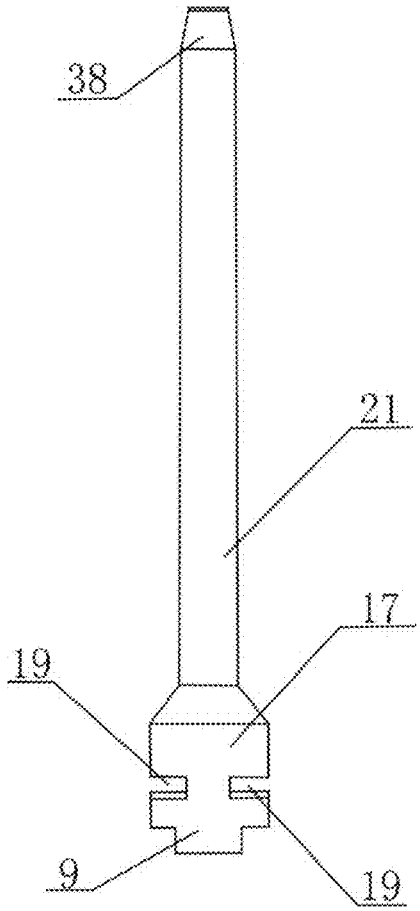
FIG. 29 is a schematic structural view of a tool, which is a slotted screwdriver, of the multifunctional tool kit according to a preferred embodiment of the present disclosure.

Preferably, the multifunctional tool kit according to the present disclosure is used together with a tool sheath. The above tools 21 are all independently inserted into the tool sheath and are packaged in the same packaging box. Before use, the multifunctional tool kit is taken off from the tool sheath, the swing locking piece 51 engaged with the receiving portion 61 is pushed aside, and then the first shank 10 and the second shank 11 are rotated by 180 degrees to expose the connecting piece 12. In this case, the first shank 10 and the second shank 11 are close to each other. Afterwards, the swing locking piece 51 is made to engage with the receiving portion 61, such that the first shank 10 and the second shank 12 cooperate to define the handle 27. In this case, the root portion 17 of the desired tool 21 is aligned with the second hole 91 and inserted into the second hole 91, until the cam pin 9 abuts the bottom of the pin hole 3, and the cover 65 is rotated such that the strip-shaped recesses 82 are engaged with the ribs 35 to lock the tool 21. In the meantime, when the strip-shaped recesses 82 are engaged with the ribs 35, the protrusions 8 are also engaged with the indents 6 to lick the cover 65, as illustrated in FIG. 4. In this case, the multifunctional tool kit is in an available state. If another tool 21 needs to be used, the cover 65 is rotated to the position as illustrated in FIG. 6, the undesired tool 21 is taken out and inserted on the tool sheath, the root portion 17 of a desired tool 21 is inserted into the second hole 91 to reach the bottom of the pin hole 3, then the cover 65 is rotated such that the strip-shaped recesses 82 are engaged with the ribs 35, and meanwhile, the second hole 91 is staggeredly engaged with the locking recess 19 to lock the tool, as illustrated in FIG. 4. When another tool 21 is still to be used, such operations may be repeated. If the multifunctional tool kit is not to be used, the first shank 10 and the second shank 11 are rotated to hide the tool 21 inserted on the connecting piece 12 in the slot 26, and is locked by engaging the locking piece with the receiving portion 61 arranged on the tail end of the first shank, and then the tool 21 is inserted on the tool sheath and received in the packaging box together with other tools 21. As such, the tool kit is easy and convenient to carry outdoors.

Preferably, the multifunctional tool kit according to the present disclosure may be applicable to homes, restaurants, repairs, tours, outdoor activities, rescues, and the like fields, and thus practically saves a large amount of space and resources. The multifunctional tool kit implements integrated functions of a plurality of tools.

The above described embodiments are merely preferred embodiments of the present disclosure, but are not intended to limit the present disclosure. A person skilled in the art would derive various modifications and variations based on these embodiments. Any modification, equivalent replacement, and improvement made without departing from the spirit and principle of the present disclosure shall fall within the protection scope of the present disclosure.

What is claimed is:

1. A multifunctional tool kit with a plurality of tools (21), comprising a connecting piece (12), a cover (65), a first shank (10), and a second shank (11); wherein the tools (21) are elected from a group comprising a knife, a table knife, a fork, a spoon, a pet comb, scissors, a box dismantling knife, a saw blade, a cross screwdriver, a hexagonal screw remover, a file, a micro flashlight, a red wind corkscrew, a peeling blade, a beer cap opener, a rope cutter, an electronic flame-off torch, a hexagonal spoon, and a slotted screwdriver, wherein each tool (21) comprises a root portion (17), the connecting piece is provided with a first left groove (1), a first right groove (5), a pin hole (3), a rivet hole (7), and two ribs (35), the two ribs being respectively arranged on a front side surface and a rear side surface of the connecting piece, the first left groove being disposed a left side surface of the connecting piece and connected to an upper end of the first shank, the first right groove being disposed on a right side surface of the connecting piece and connected to an upper end of the second shank, the pin hole being disposed in a middle of the connecting piece and interconnected to the root portion (17) of one of the plurality of tools, and the rivet hole being disposed on left and right sides of the connecting piece and allowing a rivet (23) to pass through such that the first shank and the second shank are connected to the connecting piece and the first shank and the second shank is reversely swingable by 180 degrees;

the cover (65) is movably connected to the connecting piece (12), and the cover (65) is provided with two strip-shaped recesses (82), a second hole (91), a second left groove (93), and a second right groove (88), the two strip-shaped recesses being oppositely arranged on an inner wall of the cover and engaged with the two ribs (35) arranged on the front side surface and the rear side surface of the connecting piece, the second hole being aligned with the pin hole (3) arranged on the connecting piece to allow the root portion (17) of the one of the plurality of tools (21) to be inserted, and the second left groove (93) and the second right groove (88) being aligned with the first left groove (1) and the first right groove (5) arranged on the connecting piece (12) to allow the first shank and the second shank to be folded and fastened; and the root portion (17) of the one of the plurality of tools (21) is provided with a locking recess (19), and a cam pin (9), the cam pin passing through the second hole to be inserted into the pin hole, such that the strip-shaped recesses are engaged with the ribs by rotating the cover and the locking recess is staggeredly engaged with the second hole to fix the tool to the connecting piece.

2. The multifunctional tool kit according to claim 1, wherein the first shank and the second shank are both provided with a slot (26) configured to accommodate the plurality of tools, the first shank and the second shank are reversely rotatable by 180 degrees to define a chamber (66) configured to accommodate the plurality of tools, and received on a receiving portion (31) arranged on a tail end of the first shank by a swing locking piece (51) arranged on a tail end of the second shank, such that the first shank and the second shank define a handle (27).

3. The multifunctional tool kit according to claim 2, wherein the swing locking piece is arranged on the tail end of the second shank and swingable by 180 degrees, and in case of opening for use or folding after use, the one of the plurality of tools is locked by receiving the swing locking piece in a receiving portion (61).

* * * * *